United States Patent [19]

Crossley et al.

[11] Patent Number: 4,475,880

[45] Date of Patent: Oct. 9, 1984

[54] TABLETTING MACHINES

[75] Inventors: Jack Crossley; David H. Wilson, both of Liverpool, England

[73] Assignee: Manesty Machines Limited, Liverpool, England

[21] Appl. No.: 509,852

[22] Filed: Jun. 30, 1983

Related U.S. Application Data

[62] Division of Ser. No. 247,810, Mar. 26, 1981, Pat. No. 4,403,935.

[30] Foreign Application Priority Data

Mar. 27, 1980 [GB] United Kingdom ..... 8010324

[51] Int. Cl.[3] ..... B30B 7/00

[52] U.S. Cl. ..... 425/353; 425/345; 425/355; 425/457; 425/469; 425/DIG. 35

[58] Field of Search ..... 425/259, 344, 345, 352, 425/353, 355, 457, 469, 78, DIG. 35

[56] References Cited

U.S. PATENT DOCUMENTS

| | | | |
|---|---|---|---|
| 215,452 | 5/1879 | Gill | 425/259 |
| 3,075,244 | 1/1963 | Glenn | 425/352 |
| 3,565,016 | 2/1971 | Christie | 425/353 |
| 3,566,806 | 3/1971 | Porster et al. | 425/345 |
| 3,647,331 | 3/1972 | Kuratomi | 425/78 |
| 3,677,673 | 7/1972 | Shapiro | 425/345 |
| 3,836,299 | 9/1974 | Houston et al. | 425/259 |
| 3,918,873 | 11/1975 | Crossley et al. | 425/345 |
| 4,259,049 | 3/1981 | Willich | 425/353 |

FOREIGN PATENT DOCUMENTS

| | | | |
|---|---|---|---|
| 48-748 | 1/1973 | Japan | 425/353 |
| 1481797 | 8/1977 | United Kingdom . | |
| 1481798 | 8/1977 | United Kingdom . | |

*Primary Examiner*—James Lowe

*Attorney, Agent, or Firm*—Frishauf, Holtz, Goodman & Woodward

[57] ABSTRACT

A tabletting machine having a ring-shaped die table rotatable about a generally upwardly extending axis and having dies arranged at a die surface. Punches supported in the die table and reciprocably driven with respect to the dies cooperate with punches semi-rigidly mounted on a rotatable hub to form and eject tablets from the dies. The hub is rotated to move the punches mounted thereon in a circular path to enter and exit the dies in a predetermined sequence. Individual pump means associated with the punches in the die table and means for catching and extracting loose tabletting material falling from the dies serve to reduce contamination of the many parts of the machine by the tabletting material.

11 Claims, 10 Drawing Figures

TABLETTING MACHINES

This is a division of application Ser. No. 247,810 filed Mar. 26, 1981, now U.S. Pat. No. 4,403,935.

BACKGROUND OF THE INVENTION

This invention relates to tabletting machines and concerns tabletting machines of the kind (hereinafter referred to as of the kind described) in which the powdered or granulated material to be tabletted is fed onto the surface of a rotating die table so as to fill dies in the die table and be compressed into a tablet in each die between a pair of punches, one of the punches being subsequently withdrawn from the die and the other punch being pushed through the die to eject the tablet from the die.

In a conventional tabletting machine of the kind described, the die table is horizontally disposed and individual pairs of punches operate vertically to enter the dies from opposite ends, the punches being operated by stationary cams. Means is provided for adjusting the cams thereby to adjust the amount of material which is compressed in each die to form each tablet and the thickness of the resulting tablet.

In our British Pat. Nos. 1,481,797 and 1,481,798 we describe a tabletting machine of the kind described having a continuous, adjustable cam track to operate radially outer punches, there being radially inner and outer punches operating radially with respect to the axis of rotation of a concave cylindrically surfaced die table. The use of a continuous, adjustable cam track avoids noise and wear problems encountered in conventional tabletting machines. The use of a cylindrical die table having a concave cylindrical surface has the advantage that powdered or granulated material to be tabletted moves from the surface of the die table into the dies with the assistance of centrifugal force so that feeding of the material to be tabletted, into the dies, is improved.

A problem which arises with tabletting machines in general is that relatively movable bearing surfaces of the machine are liable to contamination and wear by the material being tabletted. This is particularly true of the sliding bearing surfaces of the punches and the punch guides which require to be positioned adjacent the die table.

An object of the present invention is to reduce or eliminate this problem more particularly, although not exclusively, in a tabletting machine in which the punches operate radially of the axis of rotation of the die table.

In such a machine, the space available to the radially inner punches is restricted.

SUMMARY OF THE INVENTION

From one aspect therefore, the present invention provides a tabletting machine of the kind described in which the punches operate in the dies radially of the axis of rotation of the die table and the radially inner punches are mounted on a rotatable hub which moves the radially inner punches in a circular path to enter and exit the dies.

With this arrangement, sliding bearing surfaces for the radially inner punches are eliminated and additionally a very compact arrangement results, enabling the floor area occupied by the machine to be kept small for a given output capacity of the machine.

As will hereinafter be made clear, the radially inner punches need to be mounted semi-rigidly on the hub in order to operate radially in the dies. Also, there has to be a larger number of dies than radially inner punches, each radially inner punch progressing round the die table to enter the dies in a predetermined sequence as the machine is operated.

As regards the radially outer punches in a tabletting machine of the present invention, as so far defined, the use of sliding bearings cannot be avoided but more space is available to deal with the problem of preventing contamination of these bearings. Furthermore, the solution to this problem is applicable generally to the problem of preventing contamination of the sliding bearing surfaces of the punches and the punch guides in conventional tabletting machines of the kind described.

According to another aspect of the present invention a tabletting machine of the kind described has reciprocating punches slidably supported at one end and pump means is provided, individual to each reciprocating punch and operated with the punch to force air through an annular gap defined about the punch by a sealing sleeve surrounding an intermediate portion of the punch each time the punch is stroked in one direction.

Preferably the individual pump means rotate with the reciprocating punch and the support means therefor about the axis of rotation of the die table.

The provision of individual pump means rotating with the reciprocating punches to provide air seals protecting the sliding bearing surfaces of the punches obviates the complication of supplying compressed air from a remote source to a rotating part.

A further object of the present invention is to provide improved feeding arrangements for feeding the powdered or granulated material to be tabletted onto the surface of the die table.

Hitherto, a feed frame has confined the material to one region of the surface of the die table adjacent the ejection station for the finished tablets so that the dies move directly from the ejection station to be re-filled with tablet-forming material.

Ideally, however, to make best use of the space available, the material to be tabletted should be fed onto the die table at one side and the tablets ejected at the opposite side.

In any arrangement in which the punches operate in the dies radially of the axis of rotation of the die table so as to obtain the assistance of centrifugal force for die filling, there is a risk of fill material falling out of the dies during the run up of the machine to minimum operating speed and on the run down of the machine prior to stopping due to there being insufficient centrifugal force to fully retain the fill material during these periods. In the hitherto proposed tabletting machine as described in our British Pat. Nos. 1,481,797 and 1,481,798, such spillage can take place after the dies leave the feed frame and before the radially inner punches enter the dies, and this is particularly true if the axis of rotation of the die table is disposed horizontally or at any large angle with respect to the vertical. This is because the feed frame is placed at the lowest part of the die table surface, to achieve most efficient feeding, with the result that the dies become inverted before the radially inner punches enter the dies. In this condition, the force of gravity directly opposes the centrifugal force and the problem of spillage is aggravated. To overcome the problem a cover may be employed to run in contact with the surface of the die table between the exit of the feed frame and the location at which the radially inner punches enter the dies but this introduces an additional wear problem.

Even if the axis of rotation of the die table is disposed vertically in a radially operating machine, fill material will still fall from the horizontally disposed dies so as to leave the surface of the fill material in each die at an angle to the vertical which is the resultant of the centrifugal force acting radially outwards and the force of gravity acting vertically downwards. Ideally, therefore, the dies should travel at this angle to the horizontal so long as the fill material is not confined in the dies.

In accordance with a still further aspect, the present invention provides a tabletting machine of the kind described in which the punches operate in the dies radially of an upwardly extending axis of rotation of the die table, and the tablets are ejected radially inwardly of the die table, the die table enclosing a hollow region in the vicinity of the dies, there being a stationary feeder plate disposed in said hollow region for supporting powdered or granulated material to be tabletted at one side of said axis, above the plane of the dies, which material is to be fed across the feeder plate onto the surface of the die table and over the dies on the opposite side of said axis, the dies moving between a position below said feeder plate and a position above the feeder plate as the die table rotates, the feeder plate engaging the surface of the die table to scrape the fill of powdered or granulated material in each die level with the surface of the die table as the die moves from above to below the feeder plate.

This arrangement permits the material to be tabletted to be fed into a hollow bowl defined by the die table, above the level of the feeder plate, at the side of the axis of rotation of the die table opposite to that at which the finished tablets are ejected, it being understood that the tablet ejection station immediately precedes the die filling station through which the dies travel above the feeder plate. Accordingly, the tablets are ejected below the feeder plate and may be taken off through a downwardly extending passage. This arrangement, therefore, makes the best use of the space available for feeding the tablet material to the machine and taking off its product.

Preferably, the axis of rotation of the die table is disposed at a small angle to the vertical and the powdered or granulated material is arranged to be fed across the feeder plate, to a region at the top of the plate, to move downwardly across the plate onto the surface of the die table, the filled dies moving below the feeder plate in a lowermost arc whilst they are uncovered by the inner punches.

The angle which the axis of rotation of the die table makes with the vertical may be chosen such that the filled dies, while travelling through said lowermost arc, move with their open ends at an optimum angle to prevent spillage of their fill material during running up and stopping of the machine.

The present invention still further provides a tabletting machine of the kind described in which the die table is in the form of a ring, the punches operate in the dies radially of the axis of rotation of the die table ring, the tablets are ejected radially inwardly of the die table ring, the inner punches are mounted on a rotatable hub which moves the punches in a circular path to enter and exit the dies and the outer punches are mounted in guides carried by the die table ring, the die table ring being supported for rotation at its outer periphery, the die table ring and rotatable hub forming separate, removable units of the machine.

The benefit of these separate removable units is that they carry the punches and dies which need to be interchanged to make tablets of different sizes and shapes on the machine. By interchanging different units, which may be tooled-up (i.e. fitted with punches and dies) off the machine, the production of the machine has to be interrupted only for the time required to change the units when the style or size of the tablets is to be changed. This enables the change over to be accomplished quickly.

Where the machine employs a continuous, adjustable cam track to operate the radially outer punches as described in our British Pat. Nos. 1,481,797 and 1,481,798 the cam track itself may conveniently be formed as part of the unit comprising the die table ring. The radially outer punches may be urged towards the inside surface of the cam track by compression springs, pressure pads being provided between the radially outer ends of the radially outer punches and the inside surface of the cam track. This enables a set of pressure pads to be ground in a simple fixture to ensure constant radial thickness and the provision of pressure pads avoids wear problems on the tools.

The present invention still further provides a tabletting machine of the kind described in which the punches operate in the dies radially of the axis of rotation of the die table, the radially inner punches are mounted on a rotatable hub which moves the radially inner punches in a circular path to enter and exit the dies, the outer punches are carried by the die table, the axes of rotation of said hub and said die table are parallel and eccentrically disposed with respect to one another, the hub and the die table are drivably interconnected by a ring-gear and pinion, and means is provided to vary the ring-gear pinion center distance. By varying the ring-gear pinion center distance the backlash between these gear elements may be minimized in a simple manner without altering other machine settings.

The present invention still further provides a tabletting machine of the kind described in which said die table surface is a concave, annular, part-spherical surface, and the dies are separately formed and fitted in bores in said die table, the dies having concave, part-spherical end faces of a radius matching the part-spherical radius of the die table and lying in the part-spherical surface of the die table.

With a tabletting machine as defined in the immediately preceding paragraph, the orientation of the concave, part-spherical die end faces is immaterial to the provision of a continuously smooth die table surface which can be scraped clean by a scraper. Thus, there is no opportunity for pockets to be formed in the die table surface in which tabletting material can escape the action of the scraper as, for example, where concave, part-cylindrical surfaces are used to form the die table and the die end faces and the dies are not quite properly orientated.

The present invention includes a die for a tabletting machine in accordance with the present invention having a concave, annular, part-spherical die table surface, the die having a part-spherical end face to lie in the surface of the die table of the machine.

Both end faces of the die can be part-spherical so that the die can be reversible to extend its life.

The present invention also includes a punch for a tabletting machine in accordance with the present invention having a rotatable hub which moves the punches in a circular path to enter and exit the dies, the punch having a shaped tip end portion which initially reduces in cross-section towards the punch tip and then enlarges in cross section towards the punch tip.

Preferably, the punch has a tip end portion of uniform cross-section.

The present invention still further includes a punch for a tabletting machine for use with a die in accordance with the present invention, the punch having a formation engageable by the machine to fix the orientation of the punch tip with respect to the machine.

A tabletting machine of the kind described and embodying all the aspects of the present invention as defined above and employing tools in accordance with the present invention as above defined, will now be described by way of example, and not by way of limitation, with respect to the accompanying drawings.

DETAILED DESCRIPTION

Figure 1:
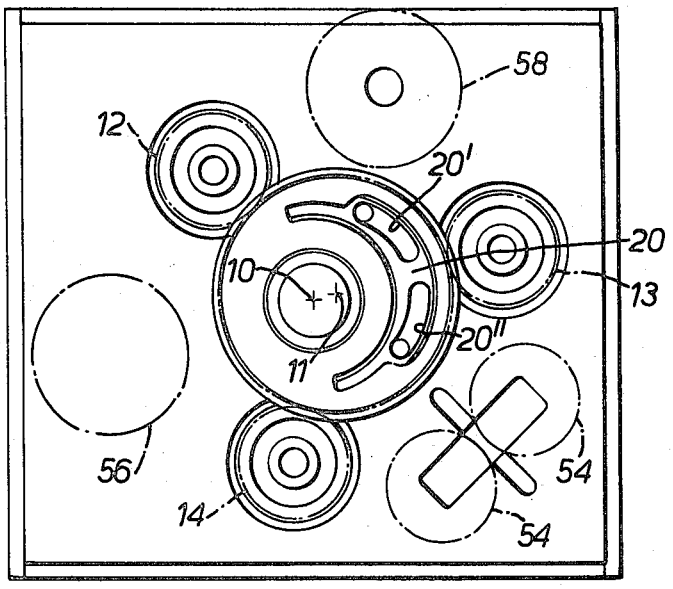
FIG. 1 is a plan view of the cabinet top on which various parts of the machine are mounted.

With reference now to the accompanying drawings, and first to FIG. 1, the parallel axes of rotation of an inner hub and an outer turret of the machine are indicated respectively at 10 and 11. Three equi-spaced turret support rollers 12, 13 and 14 support the turret for rotation about axis 11. A pair of tablet weight adjustment rollers 54, a pressure roller 56, for adjusting tablet thickness, and an ejection roller 58 constrain a flexible band or hoop 52 (see FIG. 7) in a tri-lobe shape to control the movements of radially outer punches 16 (see FIG. 7). The operation of the hoop 52, which rotates with the turret about its own axis of rotation, and the adjustments for tablet weight and tablet thickness are as described in our British Pat. Nos. 1,481,797 and 1,481,798 with reference to the corresponding parts of the machine described in the specifications of these patents, and there being one tablet produced in each die per revolution of the outer turret. FIG. 1 also shows an arcuate member 20 in the cabinet top comprising a tablet take-off passage 20′ and a separate dust extraction passage 20″.

Figure 4:
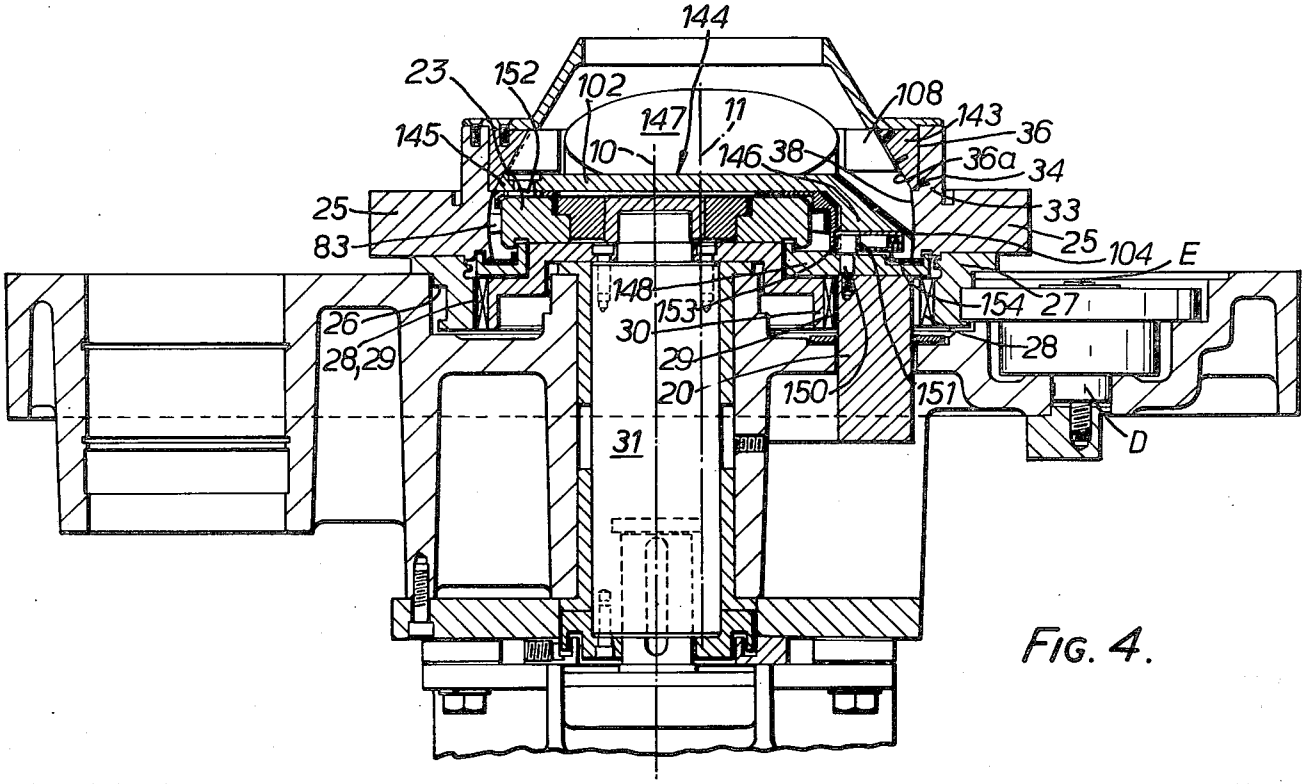
FIG. 4 is a cross-section through the top of the cabinet taken along line A—A of FIG. 3 and with a cover in position.

Referring now to FIGS. 2 to 6 and in particular to FIG. 4, the inner hub is indicated at 23 and the outer turret at 25. The rollers 12, 13, 14 run in a peripheral groove 26 in a turret support ring 27 having internal involute teeth 28 engaged by involute teeth 29 on a pinion 30. The pinion 30 is mounted on a step on the top end face of a vertically extending main drive shaft 31 and drives the turret support ring 27. The outer turret further comprises a die table in the form of a ring 33 and is bolted to the turret support ring 27 concentric therewith, the inner concave surface of the ring 33 forming the die table surface and being divided by an annular step 34 into an upper cylindrical surface portion 36 having its cylindrical axis lying along the axis 11 and a lower-part spherical surface portion 38 having its center of curvature at 39 (see FIG. 7) on the axis 11.

Figure 7:
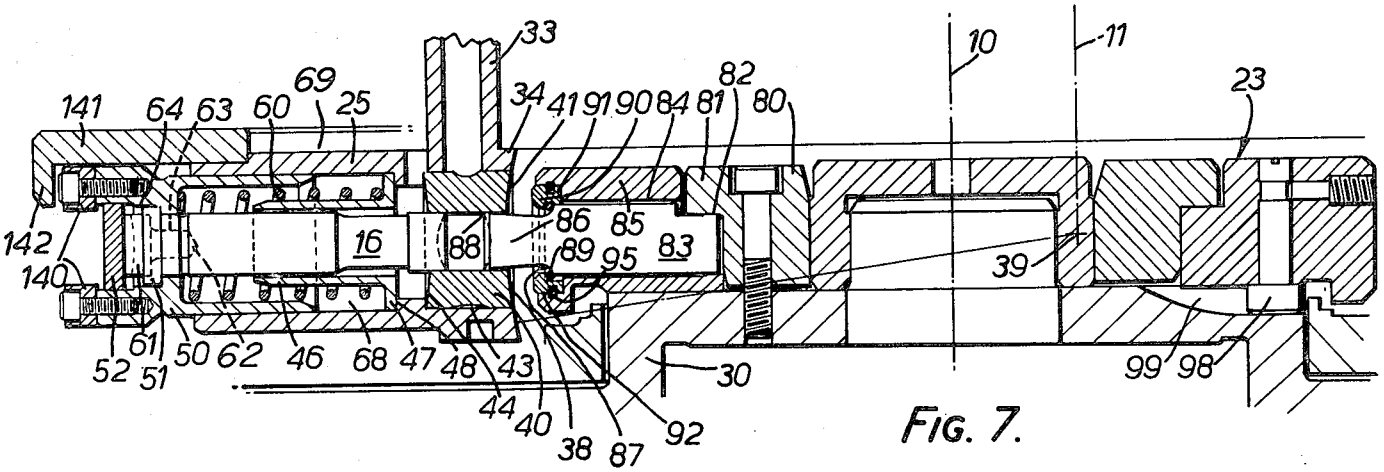
FIG. 7 is a partial view in cross-section showing a pair of cooperating, radially inner and outer punches in a die, the radially inner punch being shown at its point of maximum penetration into the die.

Referring to FIG. 7 the dies 40 are separately formed each being made up of a cylindrical body having a part-spherical, radially inner end face 41 lying flush with the surface portion 38 and centered at 39, the die bodies being locked in radial bores 43 in the die table ring 33 and seated against steps 44 therein, the axes of the bores 43 and the dies 40 all lying in a common plane normal to the axis 11.

Figure 8:
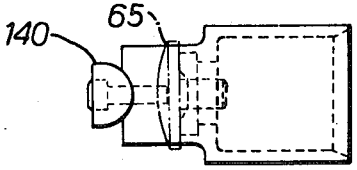
FIG. 8 shows a detail of FIG. 7.

The radially outer punches 16 are slidably supported and movable in flanged sleeves 46 positioned in the bores 43 with their flanges 47 abutting a further step 48 therein. At their radially outer ends the punches 16 carry guides in the form of cups 50, the punches 16 being rotatable in the cups and the cups 50 abutting the underside of the punch heads 51. The cups 50 slide in the radially outer ends of the bores 43, there being an open coiled compression spring 60 engaged between each cup and the flange 47 of its associated sleeve and urging a pressure pad 61 having a stem 62 rotatably received in a bore 63 in the punch, and being itself rotatably restrained in a transverse slot 64 formed in the bottom of the cup, against the inner surface of the hoop 52. The hoop 52 is received and guided by the slots 64 and the pads 61 have radiused outer surfaces 65 (see FIG. 8) to slidably engage the inner surface of the hoop.

At the radially outermost end of each of the cups 50 are fastened two safety dogs or restraining elements 140. The function of these safety dogs 140 is to ensure that the outer punches 16 complete their outward strokes even in the event of a broken spring 60 or a tight outer punch 16, so preventing damage when an inner punch 83 enters the die 40. The dogs 140 do not make contact with the radially outer circumferential surface of hoop 52 during normal running and only become effective in an emergency.

FIG. 7 also shows an annular safety plate 141 secured to the top surface of the outer turret 25. The plate 141 has a cylindrical lip 142 at its outer edge which projects downwards and prevents the cups 50, and thus the outer punches 16, from leaving the turret 25 should the restraining influence of the hoop 52 be removed due to breakage. As in the case of the safety dogs 140, the safety plate 141 is only effective in an emergency and normally makes no contact with the moving parts of the outer punch assembly.

Figure 10:
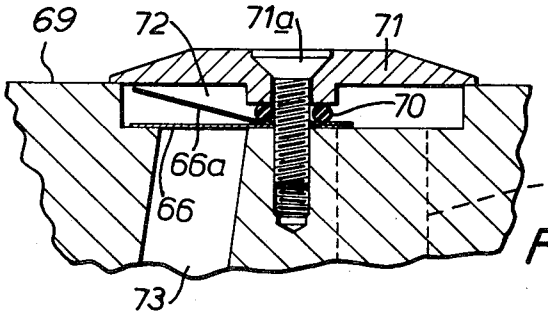
FIG. 10 is a partial view in cross-section showing a further detail of the machine.

Referring to FIG. 10 plastics film one-way flap valves 66 having angled opening-limiting metal backing plates 66*a* are provided, each one of which is associated with two adjacent bores 43 (see FIG. 7) to allow air to be sucked into the cylinder spaces 68 formed between the sealing sleeves 46 and the guides 50 when the guides 50 move radially outwardly in the bores 43, such air being expelled along the narrow annular gaps between the inner surfaces of the sleeves 46 and the outer surfaces of the punches 16, thereby to prevent the entry of powdered material being tabletted into the spaces 68 and thus protecting from contamination the sliding bearing surfaces of the outer punches, formed between the cups 50 and the bores 43, when the guides 50 move radially inwardly in the bores 43. Alternatively, an individual flap valve can be associated with each bore 43. The guide 50 and sealing sleeve 46 associated with each punch 16 form with the punch 16 and its associated bore 43 a pump means individual to the punch 16 which rotates around the axis of rotation 11 with, and which is operated with the punch to force sealing air between the sealing sleeves and the punch each time the punch is stroked in the radially inward direction.

The flap valves 66 are positioned in pockets 72 in the upwardly facing surface 69 of the turret 25, outwardly of an upstanding portion of the turret comprising ring 33 and defining the surface portion 36 and each comprises a plastics film disc and a metal disc fastened eccentrically by an '0' ring seal 70 beneath a rigid cover 71 for the pocket, held in place by a screw 71*a*. The pockets 72 communicate through bores 73 controlled by the flap valves with the underside of the turret 25 in a clean air zone sealed from penetration by material being tabletted and the flap valves, when open, communicate the bores 73 each with two further bores 74 opening into each pocket 72 and communicating the pocket with two adjacent bores 43 (FIG. 7).

The punches 16 have their radially inner ends slidably supported and operating permanently in the dies 40, and rotatable therein to satisfy the requirement of shaped tooling, that is to say, punches and dies of elongated or asymmetrical shape in cross-section. Thus, the outer punches 16 are slidably supported towards both ends and are rotatable to accommodate their cross-sectional shape to that of the dies whenever necessary.

The construction of the inner hub 23 is best appreciated from FIG. 7. The inner hub comprises a clamping ring 80 bolted to the top of the pinion 30, the ring 80 having a peripheral flange 81 overlying and engaging a step in a surrounding inner hub ring 85 and clamping the ring 85 to the top of the pinion 30. The ring 85 has radial bores 84 housing the inner punches 83, the bores 84 extending across the step and the punches 83 extending radially outwardly, with clearance, in the bores 84 and having formations engageable by the flange 81 to fix the orientation of the punch tips with respect to the machine. These formations take the form of flats 82 machined on the punches at their radial inner ends and which are overlaid by the flange 81 to prevent rotation of the punches about the axes of the punches. Each punch 83 has a shaped, radially outer end portion 86 which initially tapers radially outwardly to form a shoulder 87 and then enlarges in cross-section at a taper angle of about 5° to an extreme outer end portion or tip 88 which is of uniform cross-section and has an axial extent of about 1.5 mm. Each punch 83 is flexibly supported, towards its radially outer end, on a synthetic rubber O-ring 89 sandwiched between the shoulder 87 and an inwardly directed lip 90 of a collar 91 fixedly secured in an enlarged portion 92 of its bore 84 at its radially outer end by an outwardly springing ring 95. In this fashion, the punches 83 are non-rotatably supported with a small amount of controlled lateral freedom to deflect the O-ring to allow each punch to centralise itself in each die into which it enters as the inner hub 23 is driven in rotation with the outer turret 25. The machine now being described has twenty four dies and nineteen inner punches 83 having their radial axes all disposed in a common plane normal to the axes 10 and 11.

Each inner punch enters each die in a predetermined sequence proceeding round the ring of dies as the inner hub rotates relative to the outer turret in movements of 19/24ths of the circumference of the die ring, to move the punches in a circular path to enter and exit the dies. Thus, the punches do not enter adjacent dies in turn. Rather, the sequence is for each punch to enter a succession of dies spaced at 19/24th of the die ring circumference so that after 19 revolutions of the outer turret, during which the inner hub has performed 24 revolutions, each punch has entered each die, and the sequence commences again. The punches are subject to chordal displacement at their outer ends to centralise themselves in the dies and this displacement amounts to up to about 0.006 in. at the inner punch tips 88. The deflection of the O-rings 89 and the side loads on the punches and acting between the punch tips and the die walls is, therefore, very small. To provide for fine adjustment to align the inner punch tips 88 with the chamfers at the mouths of the dies on entry, an eccentric location button 98 carried by the hub ring 85 engages in a groove 99 in the upper surface of the pinion 30 and is rotatable upon loosening of the clamping bolts, to shift the ring 85 and therefore the inner punches 83 angularly about the axis 10. The angular misalignment of the inner punch axes on entry of the punches into the dies is about 6° and this reduces to zero at full penetration of about 5 mm. This misalignment of the punches is accommodated by their tapered portions 86 adjacent their tips.

Figure 2:
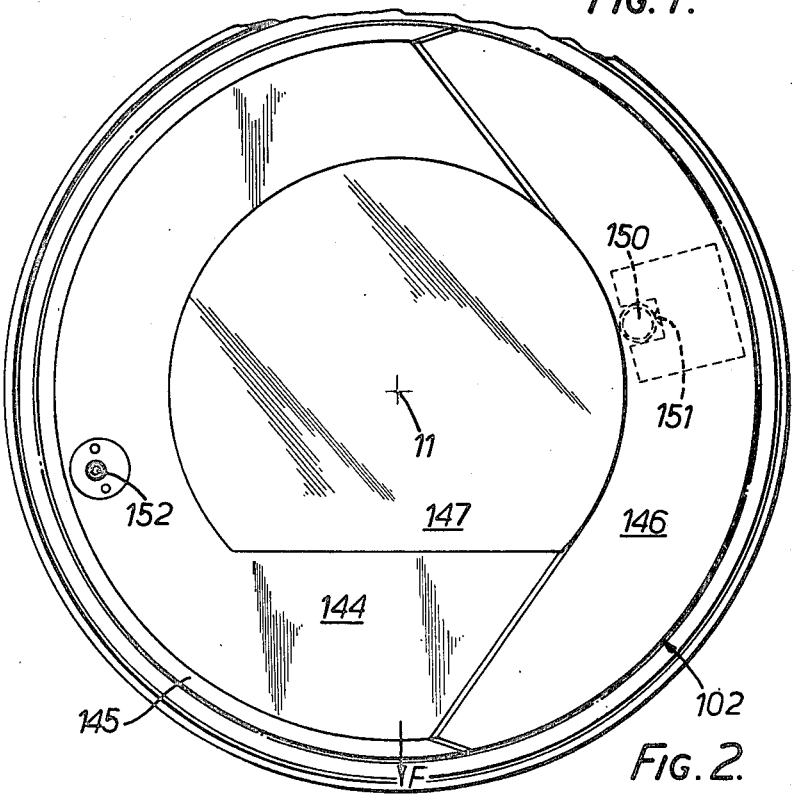
FIG. 2 is a plan view of a feeder plate for feeding powdered or granulated material to be tabletted onto the surface of a die table.
Figure 3:
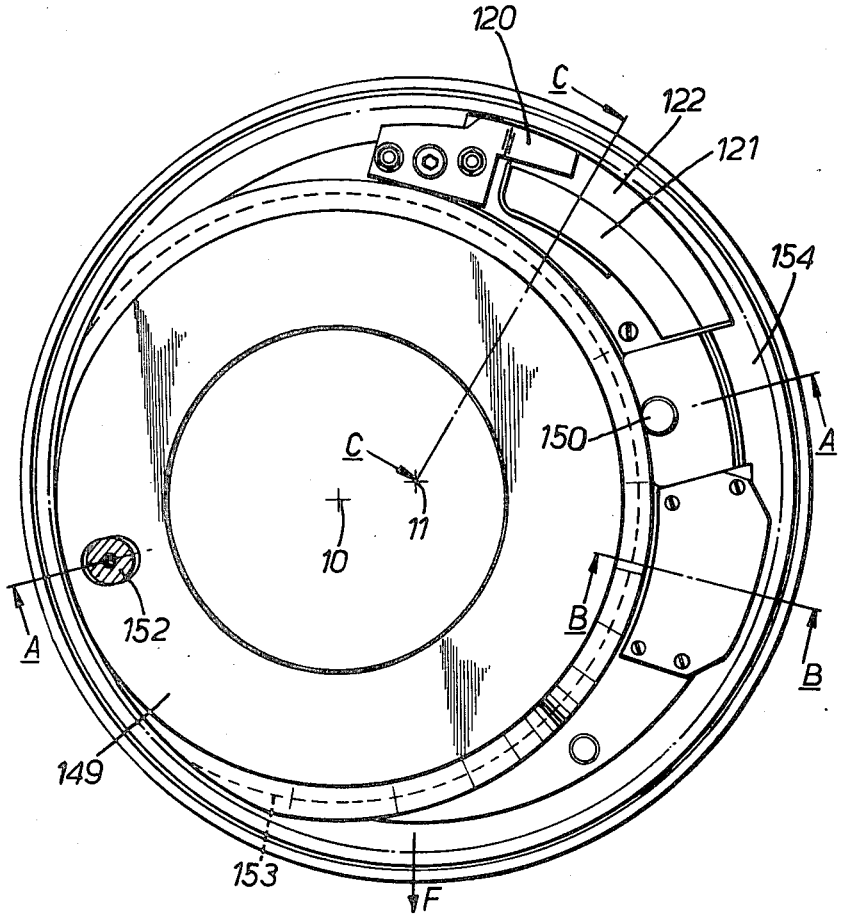
FIG. 3 is a plan view of elements of the machine positioned under the feeding arrangement.
Figure 5:
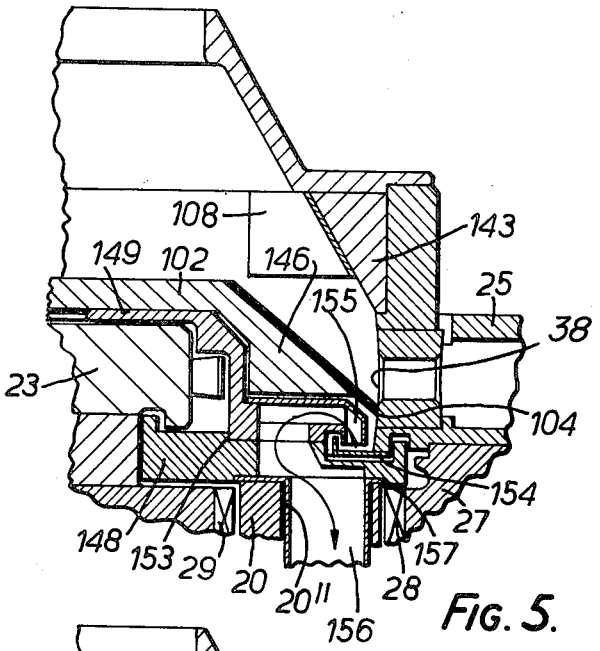
FIG. 5 is a section taken along line B—B of FIG. 3.
Figure 6:
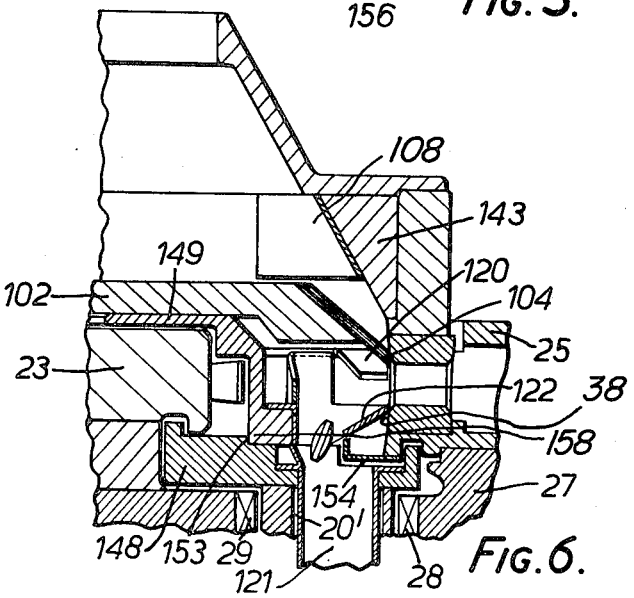
FIG. 6 is a section taken along line C—C of FIG. 3.

Referring to FIGS. 2, 3, 4, 5, 6 and 9, the powdered or granulated material to be tabletted is fed from a supply hopper 100 (FIG. 9) into the hollow interior of the die table defined by a conical surface portion 36*a* provided by an internally conical sleeve 143 of the die table surface and onto the upper surface of a larger portion 144 of a stationary feeder plate 102 (best seen in FIGS. 5 and 6) in its lower left hand region as viewed in FIG. 2. The larger portion 144 of the feeder plate is provided with a part-conical edge 145 which forms a seal with the conical surface 36*g*. The feeder plate 102 is supported by a support cap 149 (FIGS. 5 and 6) mounted on a gear cover plate 148, which is secured to arcuate member 20 (see also FIGS. 1 and 4). The support cap 149 closely surrounds the inner hub 23 (see also FIG. 3). Pin 150 (FIG. 3) serves both to secure the plate 148 to the arcuate member 20 and as a fixed location pin for the feeder plate 102. The cap 149 engages the gear plate 148 via an arcuate shoulder 153 which extends around the majority of the periphery of the cap (see FIG. 3) so that the cap stands on the gear plate and is clear of the inner hub 23 (as seen in FIGS. 5 and 6), whereby the feeder plate is stationary. A pin 152 (see FIGS. 2 and 3) serves as an adjustable location pin for the feeder plate 102. A housing for a spring biased plunger 151 (FIG. 2) is secured to the underside of a smaller, downwardly inclined arcuate portion 146 of the plate 102 (see FIG. 2). The plunger 151 and pin 150 serve to locate the feeder plate 102 and prevent it rotating. The adjustable pin 152 is for the purpose of centralising the feeder within the die surface and the spring-loaded plunger biases the edge 104 of the inclined portion of the feeder against the die surface to ensure a good seal. The cap is secured to the gear cover plate 148 by two screws 159 (see FIG. 3).

Figure 9:
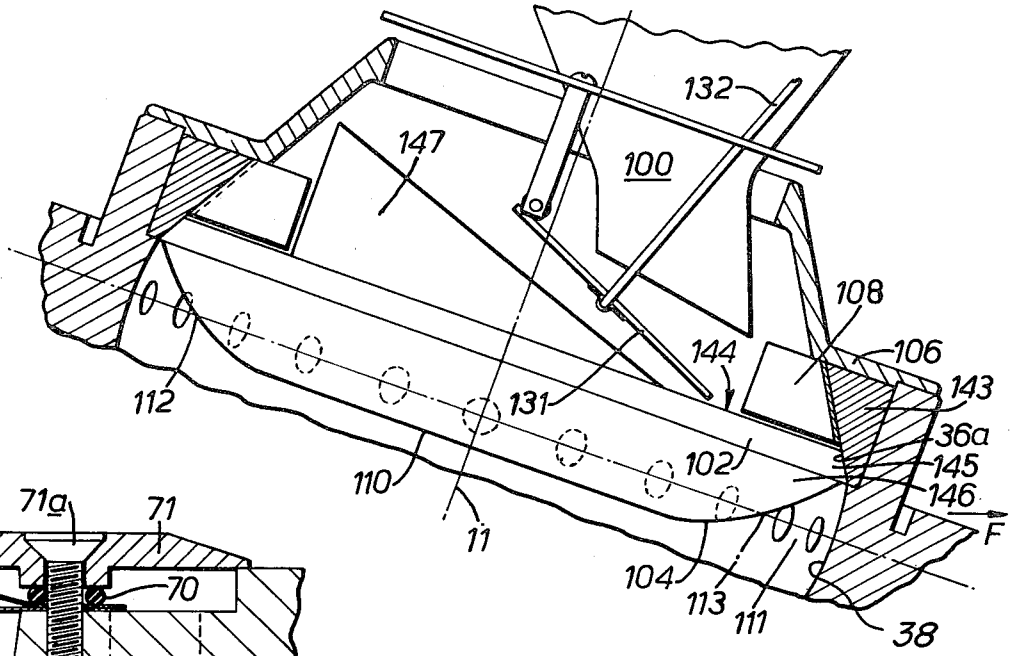
FIG. 9 is a side view, partially in cross-section, the direction F corresponding to that in FIG. 3, showing more of the arrangement for feeding the powdered or granulated material to be tabletted onto the surface of the die table.

The smaller downwardly inclined portion 146 of the feeder plate, as indicated in FIGS. 2, 5 and 9 has a part-circular edge 104 (see FIGS. 5, 6 and 9) which slides in contact with the part-spherical surface portion 38 of the die table, this edge acting as a scraper for the dies. The vanes 108 move the powdered or granulated material clock-wise from the lower left hand region of the plate 102 (FIG. 2) upwardly across the surface of the plate towards the rear of the machine and to the right across the upper region of the plate so that it falls over the ridge formed at the juncture between the flat and inclined portions of the plate and flows downwardly over the inclined portion of the plate onto the part-spherical surface 38 (FIG. 4).

In this manner, the powdered or granulated material is moved from a position to the left hand side of the axis 11 in FIG. 2 in which it is supported above the plane of the dies 40 to a position to the right hand side of the axis 11 in FIG. 2 on the surface of the die table and over the dies. Thus, as may be more readily appreciated from FIG. 9, the part-circular edge 104 makes contact with the surface 38 along a circular path 110 which intersects with the plan 111 of the dies at 112 and 113, the dies 40 moving from a position below the inclined portion 146 of the feeder plate to a position above the inclined portion of the feeder plate and then again to a position below the inclined portion of the feeder plate as they travel through the intersections 112 and 113 respectively. Between these intersections the mouths of the dies are exposed to powdered or granulated material being carried round on the surface portion 38 of the die table and the material flows into the dies to fill them. As each die travels through the intersection 113 its fill of material is scraped level with the surface 38 by the edge 104. The die then travels, uncovered, below the feeder plate 102, through the lowermost arc of the feeder plate as seen in FIG. 2, until it is entered by one of the punches 83 at the left hand side of the feeder plate as seen in FIG. 2.

The sequence of operation of the radially outer punches 16 is as described in British Pat. Nos. 1,481,797 and 1,481,798. The tablets are ejected radially inwardly from the dies 40 as the pressure pads 61 of the outer punches and the hoop 52 traverse the ejection roller 58 forcing the punch 16 through the die. Ejection occurs at a position below the inclined portion of the feeder plate 102 immediately before the dies travel through the intersection 112.

Mounted to the underside of the outer turret 25 is an annular trough 154 which rotates therewith (FIGS. 4, 5 and 6). The trough 154 serves to collect loose material falling from the dies and to prevent it collecting on the gear cover plate 148, from whence it could migrate to the synchronizing gear teeth 28, 29, particularly during run up to the required operating speed and subsequent run down. Waste material falling into the trough 154 is scavenged by applying suction to a short stationary extractor duct 155 (FIG. 5) arranged over the trough 154 via a dust extraction connector 156 extending in passage 20'' (see also FIG. 1) in member 20 and having a flange 157 clamped between the gear cover plate 148 and member 20. The duct 155 sucks loose material from the trough 154 whilst the trough rotates thereunder and effectively prevents the ingress of tabletting material to the synchronizing gear teeth 28,29 and other internal parts of the machine. A stationary, downwardly inclined take-off blade 120 (see FIGS. 3 and 6) positioned at the ejection station together with a tablet deflector 122 arranged over the trough 154 deflect the ejected tablets radially inwardly and downwardly through a tablet chute 121 arranged in the passage 20' to exit the machine. As the dies travel through the filling station above the right hand half of the feeder plate 102 the outer punches are partially withdrawn to suck fill material into the dies, the material also being pressed into the dies by the action of centrifugal force. As the pressure pads 61 and the hoop traverse the weight adjustment rollers 54 the outer punches are advanced to eject surplus feed material from each die so that when the surface of the fill is scraped level by the edge 104 of the feeder plate 102 the die contains a measured "dose" of fill. After traversing the rollers 54 the outer punches are again withdrawn to assist in preventing spillage of the measured "dose" of fill material out of each die more particularly during entry of an inner punch into the die to compress the fill and form the tablet, and this occurs as the pressure pad of the outer punch traverses the pressure roller 56. Since the open mouth of each filled die is travelling at an optimum angle of about 20° to the vertical as the die moves through the lowermost arc of the feeder plate 102 following the weight adjustment rollers, spillage of the measured "dose" of fill during running up of the machine on starting and running down of the machine when stopping, before the partial withdrawal of the outer punches becomes effective for this purpose, is also prevented. After traversing the pressure roller, the inner punches are withdrawn from the dies as they move along their circular path and the outer punches are advanced by the hoop 52 so as finally to eject the tablets as their pressure pads and the hoop traverse the ejection roller 58 as already explained.

Prior to cleaning a tabletting machine after use it is generally run until the hopper 100 is exhausted. However, not all of the flat portion of the feeder plate is swept by the vanes 108. The purpose of the circular incline 147 (see FIG. 9) mounted on the feeder plate 102 is to ensure that all material fed in by the hopper is directed into the path of the vanes 108, the central surface of the feeder plate thus being inclined too steeply for material to be retained thereon. This ensures good utilization of the tabletting material and assists cleaning down of the machine.

The feed hopper 100 has a flow adjustment flap 131 which controls the opening at its lower end. The flap is manually adjustable by means of a suitable control 132 to vary the bottom opening of the hopper and thereby regulate the flow of powdered or granulated material entering the bowl defined by the feeder plate 102 and the conical portion of the die table surface.

The use of dies 40 with part-spherical end faces located in a part-spherical surface 38 of a die table not only allows the provision of a continuous unbroken die table surface regardless of the orientation of the dies but permits the use of circular edged scraper feeder plate 102 and tablet take-off blades 120,122 which are far more readily machined. Also, where the dies are of elongated or asymmetrical shape in cross-section it is no longer necessary to form the die opening at a specific orientation with respect to its end face to ensure that it can be filled flush with the die table surface and yet be properly orientated to accept the inner punches 83.

With shaped tooling, it is important to be able to orientate the dies 40 with respect to the inner punch tips 88 without leaving any pockets in the die table surface 38 which will accumulate materials being tabletted and give rise to a 'dirty' machine. It is important also to fix the orientation of shaped inner punches 83 in the machine because the inner punches continually leave and re-enter the dies 40 so that any change in orientation of the inner punches will damage the punches and the dies. This is not true of the outer punches 16 which always operate with their tip end portions in the dies 40. It is a simple matter therefore to orientate the outer punches 16 with respect to the dies 40. The flats on the pressure pads 61 associated with the outer punches 16 engage with the slots in the sleeves 50 to maintain the pads in line contact with the flexible hoop 52 while allowing the outer punches 16 to turn freely about their longitudinal axes to orientate themselves in the dies 40 as required.

As may clearly be seen from FIG. 7 the dies 40 have part-spherical end faces at each end. This enables the dies to be reversed to extend their life. As may also be seen in FIG. 7, the dies have a 20° taper entry portion at each end of their bores. Alternatively, the dies may only have part-spherical faces at one end, in which case they would not be reversible.

The three equally spaced turret support rollers 12, 13 and 14 rotate freely on angular contact ball bearings, the inner races of which are mounted on stationary spindles. These spindles have a diameter D (see FIG. 4) which locates in the cabinet top and is slightly eccentric to their main bearing carrying diameter. An axial bolt E clamps and locks each spindle to the cabinet top. Rotating the three spindles in unison causes the turret support ring 27 to move radially with respect to axis 10. When the gear teeth 28, 29 are in optimum mesh the axial bolts E are tightened. By this means, the gear center distances are adjusted to eliminate backlash in the gears.

We claim:

1. In a tabletting machine in which powdered or granulated material to be tabletted is fed onto a concave, annular, part-spherical surface of a rotating die table so as to fill dies in the die table and be compressed into a tablet in each die between a pair of punches, one of the punches being subsequently withdrawn from the die and the other punch being pushed through the die to eject the tablet from the die;

a die having a part-spherical end face adapted to lie in the surface of the die table of the machine in use of the die.

2. A die according to claim 1, wherein both end faces of the die are part-spherical and the die is reversibly positionable in a bore therefor in the die table with a respective end face lying in the surface of the die table.

3. For use as a radially inner punch in a tabletting machine in which powdered or granulated material to be tabletted is fed onto the surface of a rotating die table so as to fill dies in the die table and be compressed into a tablet in each die between a pair of punches, one of the punches being subsequently withdrawn from the die and the other punch being pushed through the die to eject the tablet from the die, the punches operating in the dies radially of the axis of rotation of the die table, the radially inner punches being mounted on a rotatable hub which moves the radially inner punches in a circular path to enter and exit the dies;

a punch having a punch tip end portion shaped such that the cross-section initially reduces towards the punch tip and then enlarges towards the punch tip.

4. A punch according to claim 3, comprising a tip end of uniform cross-section.

5. A punch according to claim 3, comprising a formation engageable in the hub to fix the orientation of the punch tip with respect to the machine.

6. A punch according to claim 5, wherein the formation comprises a flat provided at the end of the punch opposite to the punch tip, which flat in use of the punch is overlaid by a member of the hub to prevent rotation of the punch.

7. In a tabletting machine in which powdered or granulated material to be tabletted is fed onto a concave, annular, part-spherical surface of a rotating die table so as to fill dies in the die table and be compressed into a tablet in each die between a pair of punches, one of the punches being subsequently withdrawn from the die and the other punch being pushed through the die to eject the tablet from the die; the punches operating in the dies radially of the axis of rotation of the die table, the radially inner punches being mounted on a rotatable hub which moves the radially inner punches in a circular path to enter and exit the dies;

a die having a part-spherical end face adapted to lie in the surface of the die table of the machine in use of the die; and said radially inner punches each comprising a punch having a punch tip end portion shaped such that the cross-section thereof initially reduces towards the punch tip and then enlarges towards the punch tip.

8. The machine according to claim 7, wherein both end faces of the die are part-spherical and the die is reversibly positionable in a bore therefor in the die table with a respective end face lying in the surface of the die table.

9. The machine according to claim 7, wherein each of said radially inner punches comprises a tip end of substantially uniform cross-section.

10. The machine according to claim 7, comprising a formation engageable in the hub to fix the orientation of the punch tip of said radially inner punches with respect to the machine.

11. The machine according to claim 10, wherein said formation comprises a flat provided at the end of said radially inner punch opposite the punch tip thereof, which flat in use of said radially inner punch is overlaid by a member of said hub to prevent rotation of said radially inner punch.

* * * * *